US012146371B2

(12) United States Patent
Bahemia et al.

(10) Patent No.: US 12,146,371 B2
(45) Date of Patent: Nov. 19, 2024

(54) SUCKER ROD GUIDE

(71) Applicant: OILFIELD PIPING SYSTEMS PTY LTD, Brisbane (AU)

(72) Inventors: David Adam Bahemia, East Fremantle (AU); Michael Heitzmann, Sandgate (AU); Byron Villacorta Hernandez, Oxford, MS (US)

(73) Assignee: OILFIELD PIPING SYSTEMS PTY LTD, Brisbane (AU)

( * ) Notice: Subject to any disclaimer, the term of this patent is extended or adjusted under 35 U.S.C. 154(b) by 0 days.

(21) Appl. No.: 18/124,995

(22) Filed: Mar. 22, 2023

(65) Prior Publication Data

US 2023/0220735 A1 Jul. 13, 2023

Related U.S. Application Data

(63) Continuation of application No. PCT/AU2021/051098, filed on Sep. 21, 2021.

(51) Int. Cl.
*E21B 17/10* (2006.01)
*E21B 47/009* (2012.01)

(52) U.S. Cl.
CPC ..... *E21B 17/1071* (2013.01); *E21B 47/009* (2020.05)

(58) Field of Classification Search
CPC ... E21B 17/1071; E21B 17/10; E21B 17/1042
See application file for complete search history.

(56) References Cited

U.S. PATENT DOCUMENTS

| | | | | |
|---|---|---|---|---|
| 1,758,995 | A * | 5/1930 | Armstrong | E21B 17/1071 15/104.16 |
| 2,693,986 | A * | 11/1954 | Phreaner | E21B 17/1042 166/241.4 |
| 4,088,185 | A | 5/1978 | Carson | |
| 5,941,312 | A | 8/1999 | Vermeeren | |
| 2003/0136587 | A1 * | 7/2003 | Boulet | E21B 17/10 175/323 |

(Continued)

FOREIGN PATENT DOCUMENTS

| | | |
|---|---|---|
| AU | 2012100110 4 | 3/2012 |
| WO | 2022061399 | 3/2022 |

OTHER PUBLICATIONS

International Search Report and Written Opinion for PCT/AU2021/051098, Authorized Officer Daniel Stoian, International search authority Australian Patent Office, Date of Completion Nov. 23, 2021, pp. 1-8.

*Primary Examiner* — David Carroll
(74) *Attorney, Agent, or Firm* — Scott D. Smiley; Scott M. Garrett; The Concept Law Group, P.A.

(57) ABSTRACT

A sucker rod guide for use in a well production tubing, the sucker rod guide comprising: (a) a sleeve member, including a first material having a first wear characteristic and including: (i) a passage therethrough for a sucker rod; and (ii) an outer surface; and (b) a wear member overlaying the sleeve member and including a second material having a second wear characteristic, the wear member being fixed in position relative to the sleeve member and including: (i) an inner surface; and (ii) an outer surface defining a flow path for a fluid, when in use, between the sucker rod guide and the well production tubing.

20 Claims, 6 Drawing Sheets

(56) References Cited

U.S. PATENT DOCUMENTS

| | | | | |
|---|---|---|---|---|
| 2010/0059218 | A1* | 3/2010 | Whitelaw | E21B 17/1042 166/241.1 |
| 2016/0326814 | A1 | 11/2016 | Tessier | |
| 2017/0246778 | A1 | 8/2017 | Trowbridge | |
| 2018/0080288 | A1* | 3/2018 | Nommensen | E21B 17/1078 |
| 2020/0165881 | A1 | 5/2020 | Nommensen et al. | |
| 2020/0263508 | A1 | 8/2020 | Badrak | |

* cited by examiner

SUCKER ROD GUIDE

CROSS-REFERENCE TO RELATED APPLICATION

This application claims priority to PCT Application No. PCT/AU2021/051098, filed Sep. 21, 2021, and Australian Patent App. No. 2020903408, filed Sep. 22, 2020, the entireties of each of which are hereby incorporated by reference.

FIELD OF THE INVENTION

This invention relates generally to well production technology and more particularly concerns sucker rod guides used in well production tubing. Thus, the present invention relates to a sucker rod guide. The present invention also relates to a sucker rod including the sucker rod guide, to methods of using the sucker rod guide and/or sucker rod and to methods of manufacturing the sucker rod guide and sucker rod.

BACKGROUND OF THE INVENTION

Sucker rods are linked together inside production tubing and during operation, such as well production and/or dewatering, deviation of the well components from vertical can be problematic. The greater the well depth the more likely and more serious the implications of any such deviation.

Regardless of the cause, deviation renders the rods, the rod couplings and the production tubing vulnerable to metal-to-metal frictional wear during well operation. Centring the sucker rods in the production tubing reduces such frictional wear.

Sucker rod guides seek to centre the sucker rods inside the well production tubing. Some rod guides also scrape the tubing wall to break clogs, such as paraffin, and maintain acceptable rates of flow of product from the well.

A problem with sucker rod guides is that one of their primary purposes, maintaining high productivity, is often compromised in deference to another primary purpose, long-term operation. For example, if a sucker rod guide does not adequately scrape the paraffin from the tubing, the tubing will eventually clog and reduce or cease production. In order to achieve adequate long-term scraping, more and/or wider radial ribs are incorporated in the sucker rod guide so as to increase its scraping circumference on the tubing. However, incorporation of more and/or wider ribs structurally decreases the cross-sectional area of the product flow paths, reducing productivity. Thus, the benefit of increased production gained by better scraping is offset by lost production due to structurally constricted flow.

Furthermore, if a sucker rod guide does not locate on the sucker rod securely enough to prevent it from sliding on the rod, its scraping benefit is sooner or later diminished or lost. In order to maintain longer grip security, the guide length is generally increased to increase its rod gripping surface. But a longer guide increases the drag on product flow through the guide, reducing productivity. Thus, the benefit of increased production gained by longer connection between the guide and the rod is offset, once again by lost production due to structurally constricted flow.

High and unpredictable downtime and maintenance costs caused by premature or otherwise undesirable wear or performance of the well production tubing and components such as couplings and sucker rods are serious and costly problems. These issues are even more challenging in deeper wells and when the transport fluid (slurry) in the wells is sediment-rich.

The present invention seeks to provide an improved sucker rod guide that addresses or at least partially ameliorate the problems with existing sucker rod guides. At the very least, the present invention seeks to provide a sucker rod guide that is a useful alternative to currently available sucker rod guides. Advantages could include, but are not limited to, one or more of: (i) maintaining more acceptable, long-term rate of product flow in a well production tubing (ii) higher tubing contact area and a higher flow cross-sectional area and (iii) higher flow cross-sectional area to guide length ratio.

SUMMARY OF THE INVENTION

According to a first aspect, the present invention provides a sucker rod guide for use in a well production tubing, the sucker rod guide comprising:

(a) a sleeve member, including a first material having a first wear characteristic and including:
  (i) a passage therethrough for a sucker rod; and
  (ii) an outer surface; and
(b) a wear member overlaying the sleeve member and including a second material having a second wear characteristic, the wear member being fixed in position relative to the sleeve member and including:
  (i) an inner surface; and
  (ii) an outer surface defining a flow path for a fluid, when in use, between the sucker rod guide and the well production tubing.

According to a second aspect, the present invention also provides a sucker rod for use in a well production tubing, the sucker rod comprising a sucker rod guide according to a first aspect of the present invention.

According to a third aspect of the present invention there is provided an assembly for use in a well production tubing, the assembly comprising a sucker rod as described herein with reference to the second aspect of the present invention.

According to a fourth aspect, the present invention also provides a method for manufacturing a sucker rod guide, the method comprising the steps of:

(a) providing a sleeve member, including a first material having a first wear characteristic and including a passage therethrough for a sucker rod and an outer surface; and
(b) forming a wear member over the sleeve member such that it is fixed in position relative to the sleeve member;

wherein the wear member comprises a second material having a second wear characteristic.

According to a fifth aspect, the present invention also provides a method for manufacturing a sucker rod, the method comprising the steps of:

(a) providing a sucker rod;
(b) fixing a sleeve member to the sucker rod wherein the sleeve member includes a first material having a first wear characteristic, a passage therethrough for the sucker rod and an outer surface; and
(c) forming a wear member over the sleeve member such that it is fixed in position relative to the sleeve member, wherein the wear member comprises a second material having a second wear characteristic and wherein the sleeve member and the wear member together form a sucker rod guide.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
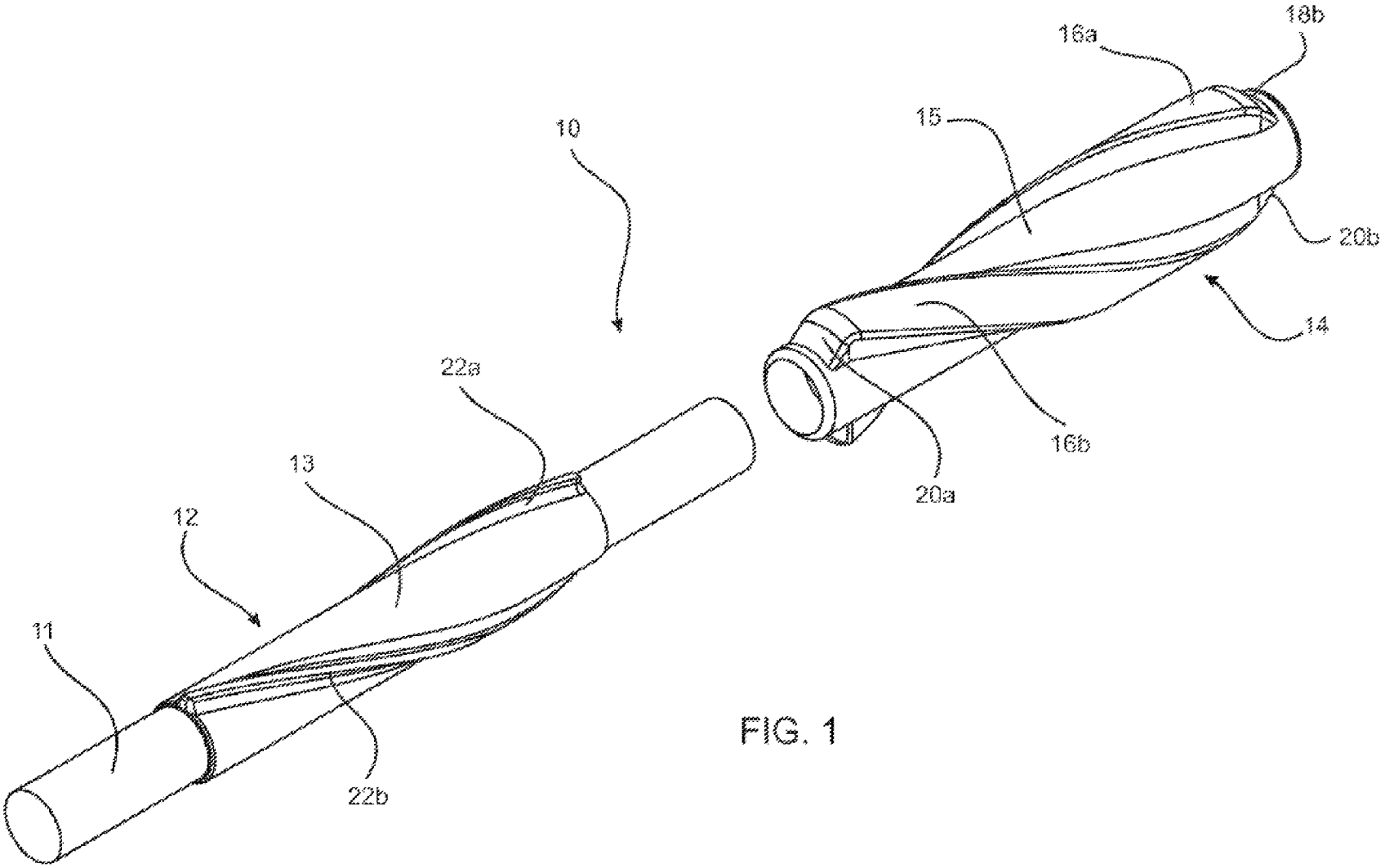
FIG. 1 is a perspective view of a sucker rod guide according to one embodiment of the first aspect of the present invention, the sucker rod guide is shown fitted to a sucker rod and with its two parts separated.

According to a first aspect, the present invention provides a sucker rod guide for use in a well production tubing, the sucker rod guide comprising:

(a) a sleeve member, including a first material having a first wear characteristic and including:
  (i) a passage therethrough for a sucker rod; and
  (ii) an outer surface; and (b) a wear member overlaying the sleeve member and including a second material having a second wear characteristic, the wear member being fixed in position relative to the sleeve member and including:
  (i) an inner surface; and
  (ii) an outer surface defining a flow path for a fluid, when in use, between the sucker rod guide and the well production tubing.

Preferably, the wear member is fixed in position relative to the sleeve member by a first fixing means.

Thus, the present invention also provides a sucker rod guide for use in a well production tubing, the sucker rod guide comprising:

(a) a sleeve member, including a first material having a first wear characteristic and including:
  (i) a passage therethrough for a sucker rod; and
  (ii) an outer surface; and (b) a wear member overlaying the sleeve member and including a second material having a second wear characteristic, the wear member being fixed in position relative to the sleeve member by a first fixing means and including:
  (i) an inner surface; and
  (ii) an outer surface defining a flow path for a fluid, when in use, between the sucker rod guide and the well production tubing.

Preferably, the first fixing means is a mechanical fitting. Even more preferably, the first fixing means comprises a male member and a female member that are compatible insofar as they are adapted to form a friction fit or to otherwise lock together to prevent the relative movement of the wear member and the sleeve member.

The first fixing means may be an integral part of the wear member and the sleeve member or may comprise a separate part attached to the wear member and the sleeve member.

Preferably, the male member of the first fixing means forms part of the sleeve member and the female member of the fixing means forms part of the wear member. However, it will be appreciated that the reverse may also apply.

Preferably, the male member projects from the outer surface of the sleeve member and the female member is formed on the inner surface of the wear member.

Preferably, the male member is formed during the manufacture of the sucker rod guide such as by moulding or some other similar technique.

The male member is shaped to increase the surface area for contact with the female member. Preferably, the male member comprises a quadrilateral shaped cross section. Even more preferably, the quadrilateral shaped cross section comprises a square, rectangle or trapezium. When the cross section is trapezium shaped it may comprise an isosceles trapezium shaped cross section.

Preferably, the male member has a first end and a second end and extends lengthwise along the outer surface of the sleeve member between said ends to define a first path. Even more preferably, the male member is a stud, tab, vane, rail, key, tongue, rib or ridge projecting from the sleeve member.

Preferably, the first path is a spiral or a helix. For example, the first path may define a screw shaped thread on the sleeve member.

Preferably, the female member formed on the inner surface of the wear member and extends into the wear member.

Preferably, the female member is a void or space formed during the manufacture of the sucker rod guide. Even more preferably, the female member is formed using the male member as a template for the female member. For example, the female member may be created by forming the wear member over, or wrapping the female member around, the sleeve member such as by moulding or some other similar technique that results in the form of the female member being based on the shape of the male member on the sleeve member.

Thus, preferably, the female member has a cross sectional shape that corresponds with and is compatible with the male member so as to form a friction fit therewith.

Preferably, the female member is a channel, groove, key-way or cut out extending into the wear member. Preferably, the female member defines a second path that corresponds to the first path.

Preferably, the first fixing means comprises at least two male members and two female members.

As an alternative or in addition to the first fixing means comprising a male member and a female member, the first fixing means may also comprise an interlayer located between the sleeve member and the wear member. Preferably, the interlayer comprises a bonding agent. Alternatively, the interlayer may comprise a third material that fixes the wear member in position relative to the sleeve member.

When the first fixing means comprises an interlayer, the interlayer may be provided alone or may be combined with the male and female members described above.

The first fixing means may also be a weld.

Preferably, the sleeve member has a higher stiffness than the wear member.

Preferably, the sleeve member has a higher CTE than the wear member.

Preferably, the sleeve member has a relatively large co-efficient of thermal expansion (CTE). Even more preferably, the sleeve member comprises a CTE of 0.5-10$K^{-1}$, 1-7$K^{-1}$, 2-6$K^{-1}$, 3-5$K^{-1}$, 3.5-4.5$K^{-1}$ or 3.75-4.25$K^{-1}$.

Preferably, the sleeve member has a shrinkage of 0.03-7.5%, 0.05-5%, 0.1-4%, 0.5-3% or 1-2%.

Preferably, the sleeve member has a relatively high stiffness. Even more preferably, the sleeve member comprises a stiffness of at least 9-20, 10-15, 10, 11, 12, 13, 14, 15, 16, 17, 18, 19 or 20 GPa.

Preferably, the first material comprises a material selected from a list of materials consisting of: a polymer, a thermoplastic polymer such as thermoplastic polyurethane, a polyamide, polyamide 6, polyamide 6-6, polyamide 11, polyamide 12, aliphatic polyketone and polypropylene.

Preferably, the first material is a shrink fit material.

Preferably, the first material comprises a reinforced polymer.

Preferably, the reinforced polymer comprises a fibre.

Preferably, the fibre is a short fibre. For example, the fibre may have an average length of 3-24, 5-20, 6-10, 6 or 10-15 mm.

Preferably, the fibre is formed from a fibre material selected from a list of fibre materials consisting of: glass (including E-glass), carbon, metal, polymer and synthetic fibres or combinations thereof.

When the first material comprises fibre, it is preferred that the fibres are aligned in the hoop direction (tangential direction to the sleeve surface (cylindrical coordinate system along the sleeve axis) of the sleeve.

Preferably, the first wear characteristic comprises a lower wear resistance than the wear member.

Preferably, the first wear characteristic comprises a higher fibre content than the wear member.

Preferably, the sleeve member comprises a main body having a generally cylindrical shape with a central void and said void forms the passage for the sucker rod.

When the sleeve member comprises the male member of the first fixing means, said male member may extend outwards from an outer surface of the main body of the sleeve member.

When the sleeve member comprises the female member of the first fixing means, said female member may extend inwards from an outer surface of the main body of the sleeve member.

Preferably, the main body of the sleeve member has a thickness of at least 1.5, 1.5-2.5, 1.5-3, 1.5-3.5 or 1.5-4 mm.

Preferably, the sleeve member is adapted to be fitted to the sucker rod to prevent relative movement therebetween. Such relative movement could be axial (along the sucker rod) and/or rotational (around the sucker rod).

Preferably, the sleeve member is adapted to be fitted to the sucker rod to prevent relative movement therebetween by being adapted to form a shrink fit with the sucker rod.

The sleeve member may also be adapted to be fitted to the sucker rod to prevent relative movement therebetween by being adapted to be chemically bonded to the sucker rod. Examples of suitable chemical bonding agents include adhesives such as but not limited to epoxy, PU, pressure sensitive adhesives, silicon adhesives, polyester- and methacrylate-based adhesives.

The sleeve member may be adapted to be fitted to the sucker rod via a mechanical interlock. For example, the sleeve member may comprise a second fixing means that comprises a second male member and a second female member that are compatible insofar as they are adapted to form a friction fit or to otherwise lock together to prevent the relative movement of the sleeve member and the sucker rod.

Preferably, the second wear characteristic comprises an abrasion rate of less than 200, 190, 180, 174, 170, 160, 150, 140, 130, 120, 110, 100, 90, 80, 70, 60 or 50 $mm^3$ of volumetric loss from a DIN ABRASION TESTING AS1683.21 @ 10N.

Preferably, the wear member overlays at least 50, 60, 70, 80, 90 or 95% of the surface area of the sleeve member. Even more preferably, the wear member overlays the entire surface area of the sleeve member.

Preferably, the wear member comprises a stiffness of 0.2-20, 0.4-18, 0.6-17, 0.8-16, 1-15, 1.5-14 or 2-12 GPa.

Preferably, the wear member is more wear resistant than the sleeve member.

Preferably, the second material comprises a material selected from a list of materials consisting of: a polymer, a thermoplastic polymer such as thermoplastic polyurethane or polyethylene terephthalate, a polyamide, polyamide 6, polyamide 6-6, polyamide 11, polyamide 12, aliphatic polyketone, polyethylene, polyacetal such as polyoxymethylene, thermoplastic fluoropolymer such as polyvinylidene difluoride and PTFE.

The second material may comprise a reinforced polymer or a non-reinforced polymer.

The second material may comprise a lubricant.

The second material may comprise a toughener.

Preferably, the wear member comprises a main body having a generally cylindrical shape with a central void.

When the wear member comprises the female member of the first fixing means, said female member may extend outwards from an inner surface of the main body of the wear member.

When the wear member comprises the male member of the first fixing means, said male member may extend inwards from the inner surface of the main body of the wear member.

Preferably, the main body of the wear member is thicker than the sleeve member. Preferably, the main body of the wear member has a thickness of 1.75, 2, 2.25, 2.5, 2.75, 3, 3.25 or 3.5 mm.

Preferably, the wear member is adapted to be fitted to the sleeve member to prevent relative movement therebetween. Such relative movement could be axial (along the sleeve member) and/or rotational (around the sleeve member).

Preferably, the wear member is fitted to the sleeve member by the first fixing means which is described in more detail above.

Preferably, the wear member is adapted to be fitted to the sleeve member to prevent relative movement therebetween by being adapted to be moulded over the sleeve member. The wear member may also be adapted to form a shrink fit with the sleeve member.

The wear member may also be adapted to be fitted to the sleeve member to prevent relative movement therebetween by being adapted to be chemically bonded to the sleeve member. Examples of suitable chemical bonding agents include adhesives such as but not limited to epoxy, PU, pressure sensitive adhesives, silicon adhesives, polyester and methacrylate-based adhesives.

Preferably, the flow path for a fluid is non-linear. Even more preferably, the flow path for a fluid is helical or spiral shaped.

Preferably, the wear member further comprises a fluid flow enhancer.

Thus, the present invention also provides a sucker rod guide for use in a well production tubing, the sucker rod guide comprising:

(a) a sleeve member, including a first material having a first wear characteristic and including:
  (i) a passage therethrough for a sucker rod; and
  (ii) an outer surface; and
(b) a wear member overlaying the sleeve member and including a second material having a second wear characteristic, the wear member being fixed in position relative to the sleeve member and including:

(i) an inner surface;

(ii) an outer surface defining a flow path for a fluid, when in use, between the sucker rod guide and the well production tubing; and (iii) a fluid flow enhancer.

The fluid flow enhancer decreases turbulence and/or generates lift and hence improves fluid flow during use.

Preferably, the fluid flow enhancer overlays at least a part of the first fixing means.

Preferably, the fluid flow enhancer comprises a projection from the main body of the wear member.

Preferably, the projection is formed during the manufacture of the wear member such as by moulding or some other similar technique.

Preferably, the projection comprises a quadrilateral shaped cross section. Even more preferably, the quadrilateral shaped cross section comprises a square or rectangle.

Preferably, the projection has a first end and a second end and extends lengthwise along the outer surface of the main body of the wear member between said ends to define a second path.

Preferably, the first and/or second ends of the projection comprise a bevelled or chamfered face on the first and/or second ends of the projection. Said faces further improve fluid flow during use.

Preferably, the second path is a spiral or a helix. For example, the second path may define a screw shaped thread on the wear member.

Preferably, the second path overlays the first path of the male member of the first fixing means.

Preferably, the projection is a foil, tab, vane, rail, rib or ridge.

There are benefits in being able to accurately and efficiently monitor the performance of the sucker rod guide, and in particular the wear member, to ensure optimal performance.

Thus, preferably, the sucker rod guide further comprises a retaining means for a performance monitor component.

The retaining means may form part of the sleeve member, the first fixing means and/or the wear member. Preferably, the retaining means forms part of the first fixing means and/or the wear member.

The retaining means may comprise a cavity or void.

The shape and configuration of the cavity or void and the number thereof depend on the nature of the performance monitor component. In some embodiments a single cavity or void is provided. In other configurations, a plurality of cavities or voids are provided.

When a plurality of cavities or voids is provided, they may be provided at the same depth within the sucker rod guide or part thereof or at different depths therein. When the performance monitor component is a detectable material (see further details below) different levels of wear can be identified by including a plurality of cavities or voids at different depths within the sucker rod guide or part thereof.

The retaining means for a performance monitor component may also comprise a separate component in the form of a receptacle that defines the cavity or void.

Preferably, the receptacle is adapted to friction fit on the sleeve member. Even more preferably, when the first fixing means forms part of the sleeve member, the receptacle is adapted to friction fit on the first fixing means.

Preferably, the receptacle defines a groove that is shaped and sized to be compatible to form a friction fit with the first fixing means.

The receptacle may be formed from a material that is less wear resistant than the wear member.

The receptacle may comprise a removable cap and a body. In this regard, the removable cap can be removed to enable the performance monitor component to be inserted into the body of the receptacle.

Preferably, the removable cap is adapted to form a friction fit with the body of the receptacle.

Preferably, the removable cap is formed from a material that is less wear resistant than the wear member.

Preferably, the sucker rod guide comprises a plurality of receptacles.

The performance monitor component may be a sensor.

Preferably, the sensor is for temperature, pressure and/or vibration.

Preferably, the sensor further comprises a transmitter for transferring data to a remote location.

The performance monitor may be a detectable material. When the performance monitor is a detectable material the retaining means be adapted to release the detectable material when the wear of the sucker rod guide breaches a part of the retaining means, such as the wall of the cavity or void, and the detectable material is released therefrom or is otherwise detectable.

Preferably, the detectable material is selected from a group consisting of: a RFID tag, a micro-RFID tag, coloured material, fluorescent material, radioactive material, fluorescein, PTSA (1,3,6,8 pyrenetetrasulfonic acid, sodium salt), rhodamine, alexa, and eFlour.

The performance monitor component, such as the detectable material, may also be integrated into the material forming the sucker rod guide or part thereof. Preferably, the detectable material is located in said material so that it is released when the sucker rod guide is performing sub-optimally.

According to a second aspect, the present invention also provides a sucker rod for use in a well production tubing, the sucker rod comprising a sucker rod guide according to a first aspect of the present invention.

Preferably, the sucker rod comprises:

(a) a sucker rod guide mounted thereon via a passage through the sucker rod guide, and the sucker rod guide comprises:

(i) a sleeve member, including a first material having a first wear characteristic and an outer surface; and (ii) a wear member overlaying the sleeve member and including a second material having a second wear characteristic, the wear member being fixed in position relative to the sleeve member and including an inner surface; and an outer surface defining a flow path for a fluid, when in use, between the sucker rod guide and the well production tubing.

Preferably, the sucker rod comprises a plurality of sucker rod guides.

The sucker rod may form part of an assembly for use in a well production tubing. Thus, according to a third aspect of the present invention there is provided an assembly for use in a well production tubing, the assembly comprising a sucker rod as described herein with reference to the second aspect of the present invention.

Preferably, the assembly comprises a plurality of sucker rods.

According to a fourth aspect, the present invention also provides a method for manufacturing a sucker rod guide, the method comprising the steps of:

(a) providing a sleeve member, including a first material having a first wear characteristic and including a passage therethrough for a sucker rod and an outer surface; and (b) forming a wear member over the sleeve member such that it is fixed in position relative to the sleeve member;

wherein the wear member comprises a second material having a second wear characteristic.

Preferably, the step of forming a wear member over the sleeve member comprises moulding. Even more preferably, the moulding comprises injection moulding or injection over moulding.

Preferably, the method further comprises the step of locating a retaining means for a performance monitor component on the sleeve member, prior to forming the wear member over the sleeve member.

Thus, the present invention also provides a method for manufacturing a sucker rod guide, the method comprising the steps of:

(a) providing a sleeve member, including a first material having a first wear characteristic and including a passage therethrough for a sucker rod and an outer surface;

(b) locating a retaining means for a performance monitor component on the sleeve member;

(c) forming a wear member over the sleeve member such that it is fixed in position relative to the sleeve member;

wherein the wear member comprises a second material having a second wear characteristic.

Even more preferably, when the first fixing means forms part of the sleeve member, the retaining means for the performance monitor component is located on the first fixing means.

According to a fifth aspect, the present invention also provides a method for manufacturing a sucker rod, the method comprising the steps of:

(a) providing a sucker rod;

(b) fixing a sleeve member to the sucker rod wherein the sleeve member includes a first material having a first wear characteristic, a passage therethrough for the sucker rod and an outer surface; and (c) forming a wear member over the sleeve member such that it is fixed in position relative to the sleeve member, wherein the wear member comprises a second material having a second wear characteristic and wherein the sleeve member and the wear member together form a sucker rod guide.

Preferably, the step of fixing a sleeve member to the sucker rod comprises moulding. Even more preferably, the moulding comprises a shrink fitting process.

Preferably, the step of forming a wear member over the sleeve member comprises moulding. Even more preferably, the moulding comprises injection moulding or injection over moulding.

One example of a method of manufacturing a sucker rod comprises one or more of the steps consisting of:

(i) providing the sucker rod supported in a first mould;

(ii) forming the sleeve member on the sucker rod by moulding the sleeve member thereon using the first mould and allowing it to cool;

(iii) releasing the sucker rod and sleeve member combination from the first mould;

(iv) placing the sucker rod and sleeve member combination from (iii) in a second mould (v) moulding the wear member on to the sleeve member in a second mould and allowing to cool; and (vi) releasing the sucker rod, sleeve member, wear member combination from the second mould.

The method may involve the formation of a plurality of sucker rod guides on the sucker rod.

Preferably, the method further comprises the step of locating a retaining means for a performance monitor component on the sleeve member, prior to forming the wear member over the sleeve member.

Thus, the present invention also provides the present invention also provides a method for manufacturing a sucker rod, the method comprising the steps of:

(a) providing a sucker rod;

(b) fixing a sleeve member to the sucker rod wherein the sleeve member includes a first material having a first wear characteristic, a passage therethrough for the sucker rod and an outer surface; and (c) locating a retaining means for a performance monitor component on the sleeve member;

(d) forming a wear member over the sleeve member such that it is fixed in position relative to the sleeve member, wherein the wear member comprises a second material having a second wear characteristic and wherein the sleeve member and the wear member together form a sucker rod guide.

Even more preferably, when the first fixing means forms part of the sleeve member, the retaining means for the performance monitor component is located on the first fixing means.

Advantages

Whilst not limited to the following applicant believes the present invention has a number of advantages including one or more of the following:

(i) improved wear performance;

(ii) over moulding enables any polymer to be used as wear member;

(iii) sleeve member provides better traction to sucker rod;

(iv) hydrolysis and degradation resistance can be achieved with the selection of polymers with desired characteristics.

Those skilled in the art will appreciate that the invention described herein is susceptible to variations and modifications other than those specifically described. The invention includes all such variation and modifications. The invention also includes all of the steps and features referred to or indicated in the specification, individually or collectively and any and all combinations or any two or more of the steps or features.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness. None of the cited material or the information contained in that material should, however be understood to be common general knowledge.

The present invention is not to be limited in scope by any of the specific embodiments described herein. These embodiments are intended for the purpose of exemplification only. Functionally equivalent products and methods are clearly within the scope of the invention as described herein.

The invention described herein may include one or more range of values (e.g. size etc). A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all technical terms used herein have the same meaning as commonly understood to one of ordinary skill in the art to which the invention belongs.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. In the various Figures the same reference numerals have been used to identify similar elements.

A sucker rod, generally indicated by the numeral 10, according to an embodiment of the second aspect of the present invention, and incorporating a sucker rod guide according to an embodiment of the first aspect of the present invention is illustrated in FIGS. 1 and 2A-2D.

The sucker rod guide is attached to the main body 11 of the sucker rod 10 and includes a sleeve member 12 and a wear member 14.

The sleeve member 12 has a generally cylindrical main body 13 and is formed of a first material in the form of a shrink fit material, in the form of polyamide 6 with 50% glass fibres or polypropylene with 50% glass fibres, where the glass fibres are longer, that has allowed for the sleeve member 12 to be fixed to the main body 11 of the sucker rod 10 using a heat moulding process.

The wear member 14 has a generally cylindrical main body 15 and is formed of a second material in the form of a shrink fit material that has allowed for the wear member 14 to be fixed to the sleeve member 12 using a heat moulding process. The second material is in the form of a base polymer (e.g. PA12), with or without functional fillers such as graphene, graphite, MoS2, WS2, oils, metallic soaps, surfactants, lubricants, nucleating agents, antioxidants, nanomaterials, stabilizers, and other additives that may be compounded into the base polymer in order to induce wear resistance, lubrication and functional properties to the wear member.

Projecting from the outer surface of the main body 15 wear member 14 is a fluid flow enhancer in the form of a pair of vanes 16*a*, 16*b* that extend lengthwise along the outer surface of the main body 15 of the wear member 14. Vanes 16*a*, 16*b* are spaced equidistantly and define a second path in the form of a spiral. Each of the first and second ends 18*b*, other end not shown of vane 16*a* and the first and second ends 20*a*, 20*b* of vane 16*b* define a bevelled face that has a profile to improve fluid flow during use. When fixed to the sleeve member 12, the vanes 16*a*, 16*b* of the wear member 14 overlay the first fixing means which is described in more detail below.

When in use, and deployed in a well production tubing (not shown), the parts of the outer surface of the main body 15 between the vanes 16*a*, 16*b* define a flow path for a fluid, such as oil or gas, between the sucker rod guide 10 and the well production tubing (not shown).

The wear member 14 is fixed in position relative to the sleeve member 12 by a first fixing means in the form of a pair of male members, that define ridges 22*a*, 22*b* that are integrated on the outer surface 13 of the sleeve member 12, and a pair of female members, the define channels 24*a*, 24*b* that are integrated in the inner surface of wear member 14. The ridges 22*a*, 22*b* are formed of the same material as the rest of eth sleeve member 12, have a trapezoidal cross-sectional shape and are compatible with channels 24*a*, 24*b* so as to form an interlocking mechanical fitting between the sleeve member 12 and the wear member 14. The internal angle 26 of the trapezoidal cross-sectional shape is about 920.

Figure 2A:
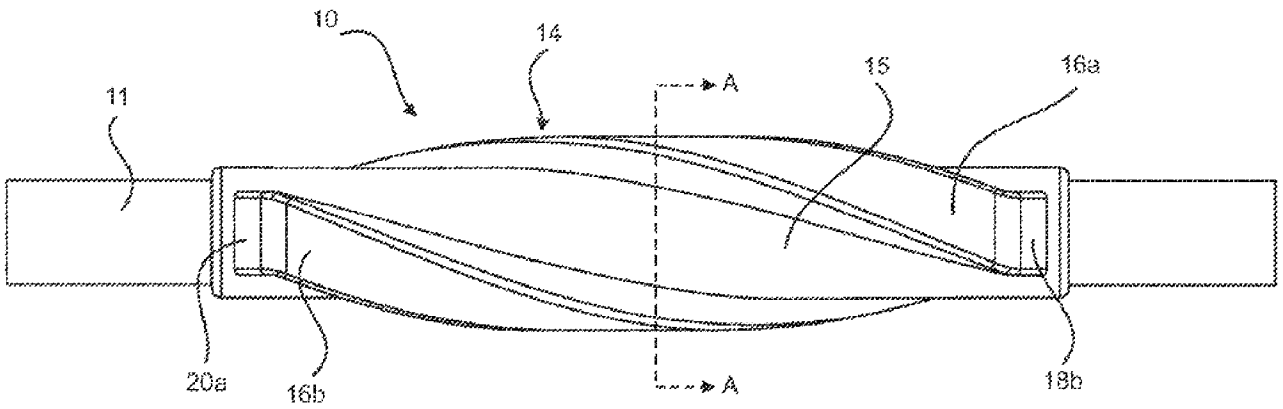
FIG. 2A is a side view of the sucker rod guide in FIG. 1 assembled and fitted to a sucker rod.
Figure 2B:
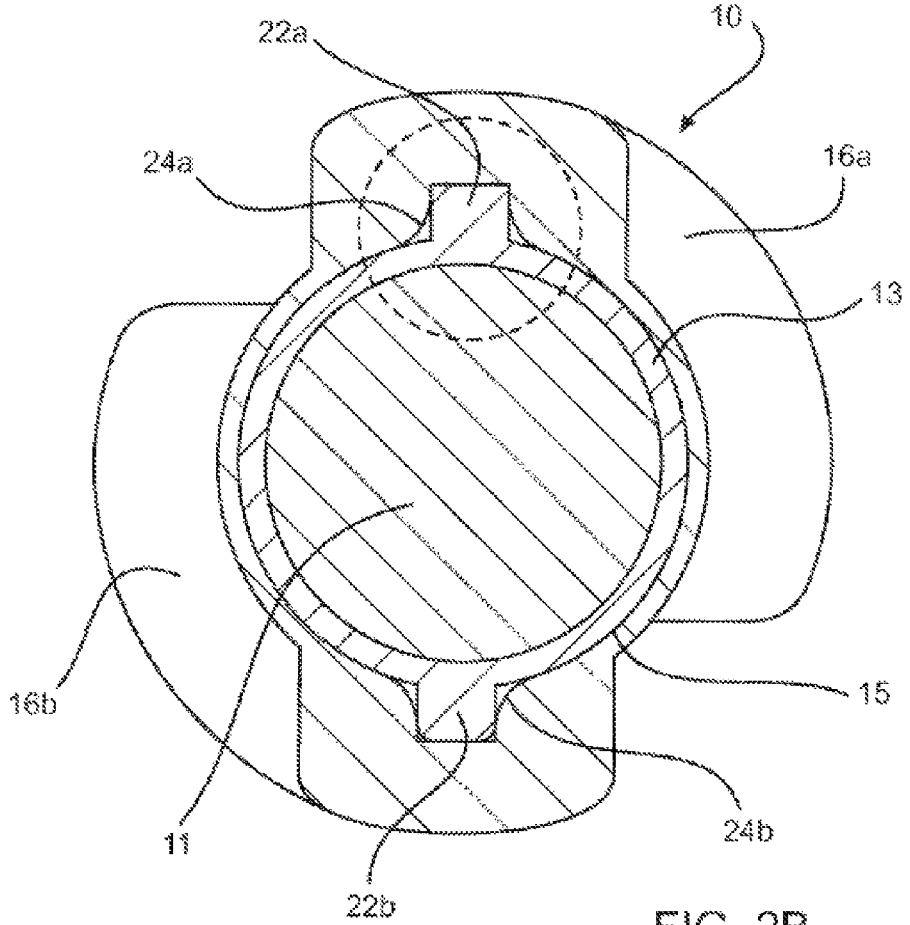
FIG. 2B shows a view through section A-A in FIG. 2A.
Figure 2C:
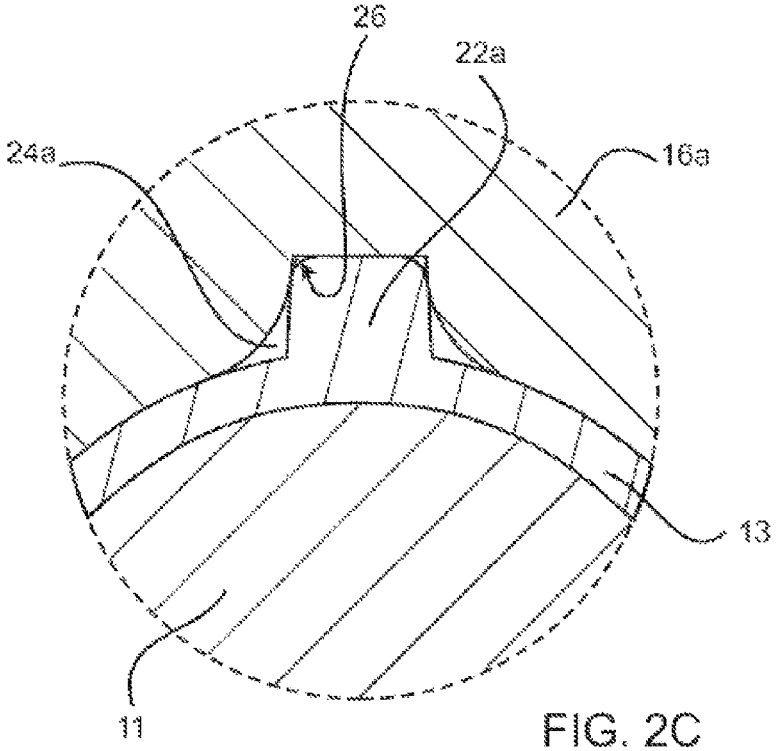
FIG. 2C shows a detailed view of section B in FIG. 2B.
Figure 2D:
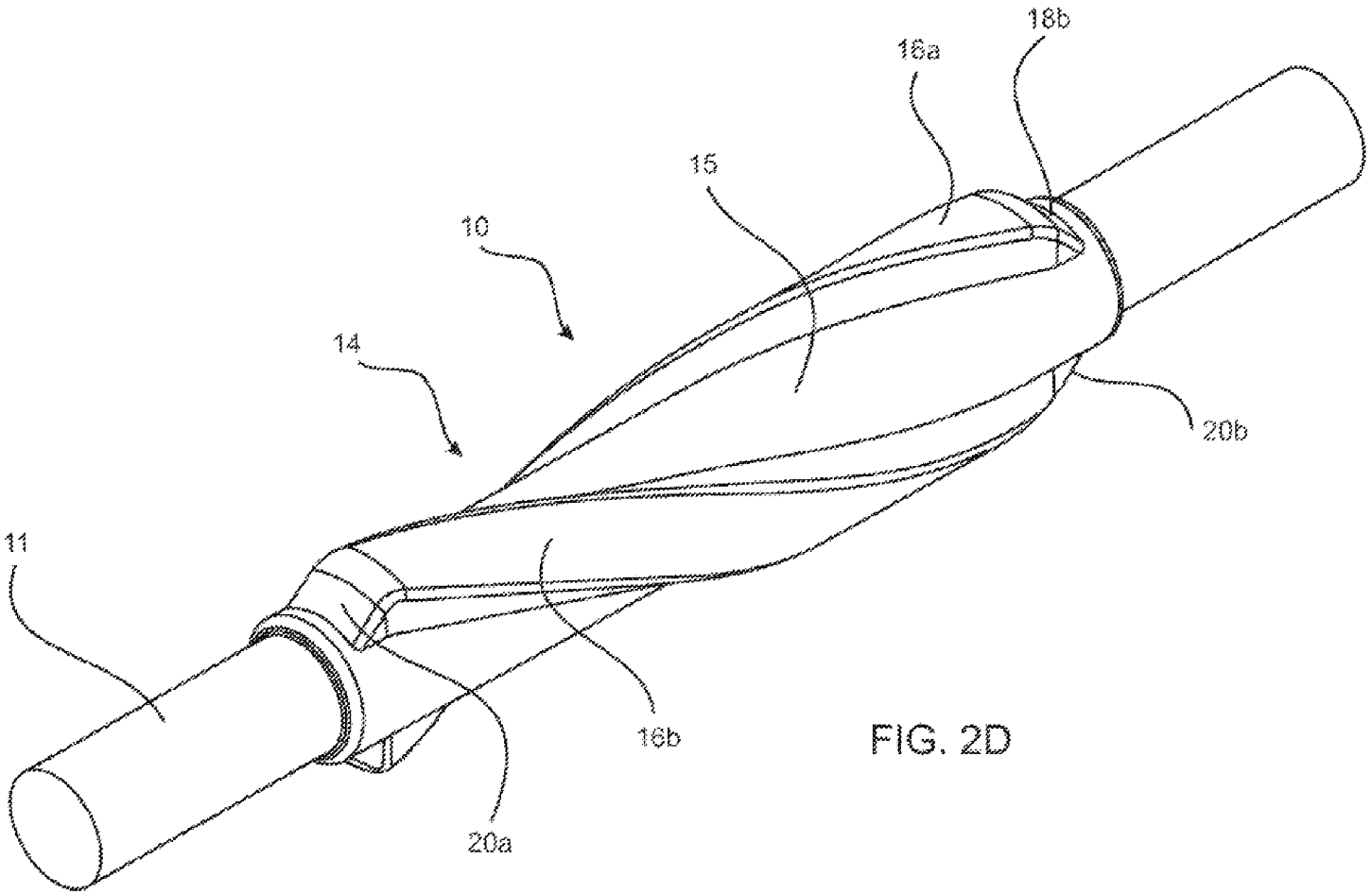
FIG. 2D is a perspective view of FIG. 2A.

When the sucker rod guide 10 is formed by overlaying the wear member 14 on the sleeve member 12, the vanes 16*a*, 16*b* of the wear member 14 overlay the interlocked ridges 22*a*, 22*b* and channels 24*a*, 24*b* and the second paths defined by the vanes 16*a*, 16*b* overlay the first paths defined by the interlocked ridges 22*a*, 22*b* and channels 24*a*, 24*b*. This is best illustrated in FIG. 2B.

When the sucker rod guide 10 is formed by moulding the wear member 14 over the sleeve member 12, it will be appreciated that there will be negligible or zero space between the respective parts. However, other manufacturing methods may result in the creation of small spaces therebetween.

The sucker rod guide 10 is fitted to the sucker rod 11 using a moulding process as follows:

1. Moulding of Sleeve Member 12 onto the Main Body 11 (or Metal Rod)

In this step, the main body 11 (i.e., a metal rod) is placed inside the mould with the shape of the sleeve member 12. Once in the right position, the mould is closed, and the based polymeric material is injected in the mould cavity. For this to take place, the material (i.e., a reinforced polymer grade) is preheated and melted at temperatures ranging 150-400 C (depending on the polymer type) and injected at pressures ranging 50-140 bar. The temperature of the mould is kept between 25 and 150 C depending on requirements imposed by the polymer type. The injected material is kept under pressure (up to 140 bar) for a desired amount of time (5-300 secs) during which the material sets and solidifies. Upon time completion, the mould is open and the sleeve member 12 is removed from the injection moulding unit.

Note: Prior to this injection step, the main body 11 may be treated by means of a number of cleaning steps or by applying a set of chemical or adhesive treatments.

2. Moulding of Sucker Rod Guide 10

Once the sleeve member 12 has been manufactured, this one is, in turn, placed on a second mould with the shape of the sucker rod guide 10. Once the ridges 22*a* and 22*b* of the sleeve member 12 have been aligned with the mould cavities that will yield vanes 16*a* and 16*b* of the soon-to-be sucker rod guide 10, a second material is injected on top of the sleeve member 12 (this is referred to as an overmoulding step). Again, this second polymeric material (i.e., a formulated polymer grade) is heated to temperatures ranging 150-350 C for it to flow as a melt during the injection process. The melting process takes place in the barrel/screw of the injection unit. Once aligned, the second mould is closed, and the injection of the materials takes place at pressures ranging 50 to 140 bar. This injection step takes a matter of a few seconds. Again, the polymer is given some cooling time (depending on the type of polymer again) inside of the mould to fully set under back pressure (up to 140 bar). Once the material is cooled down, the mould is open and the full sucker rod guide 10 is released.

Figure 3:
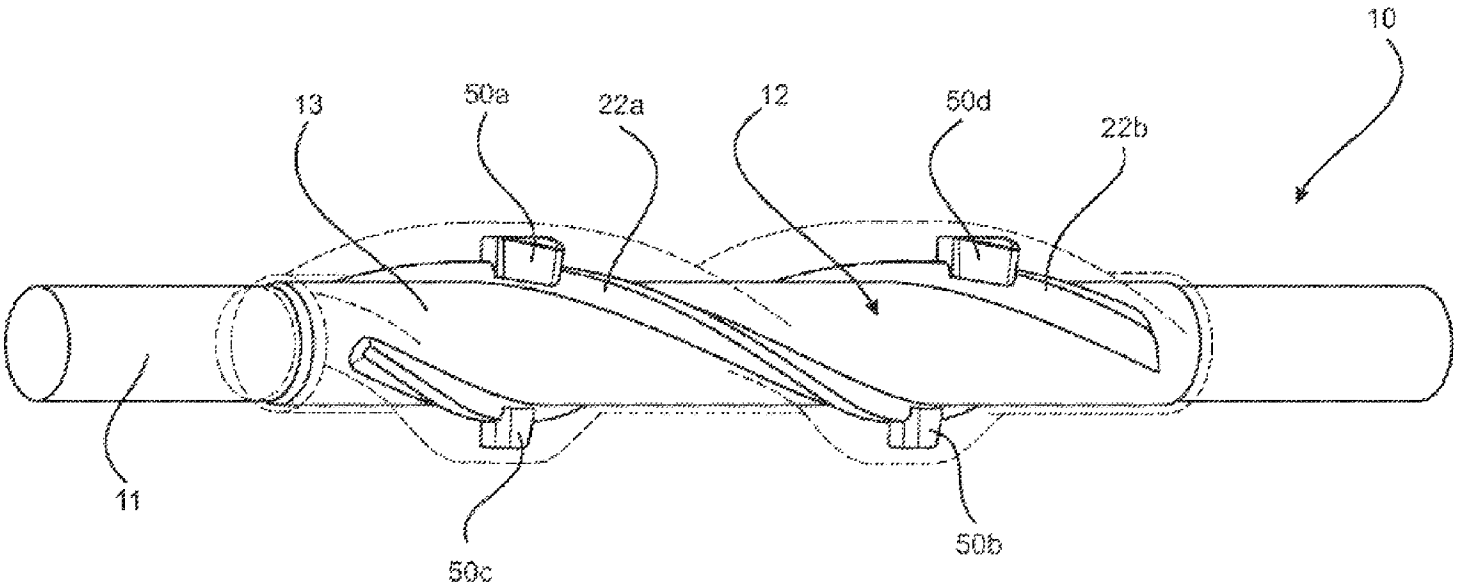
FIG. 3 is a side view of the sucker rod guide in FIG. 1 further comprising a retaining means for a performance monitor component in the form of a plurality of receptacles.

FIG. 3 depicts the same sucker rod as in FIGS. 1 and 2A-2D except it further comprises a retaining means for a performance monitor component in the form of a plurality of receptacles 50*a-d*. The receptacles 50*a*-50*d* are friction fitted to the first fixing means in the form of the pair of male members, that define ridges 22*a*, 22*b* that are integrated on the outer surface 13 of the sleeve member 12.

Figure 4B:
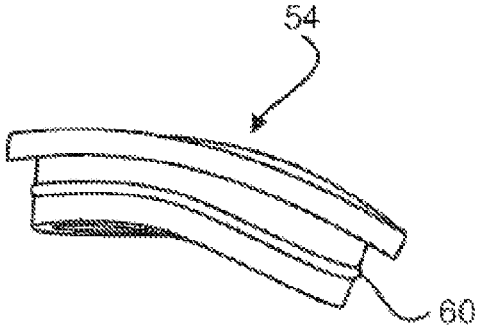
FIGS. 4A to 4C depict, in more detail, the receptacles in FIG. 3, with FIG. 4A showing the body of the receptacle, FIG. 4B the cap portion of the receptacle and FIG. 4C the receptacle in its assembled form.
Figure 4A:
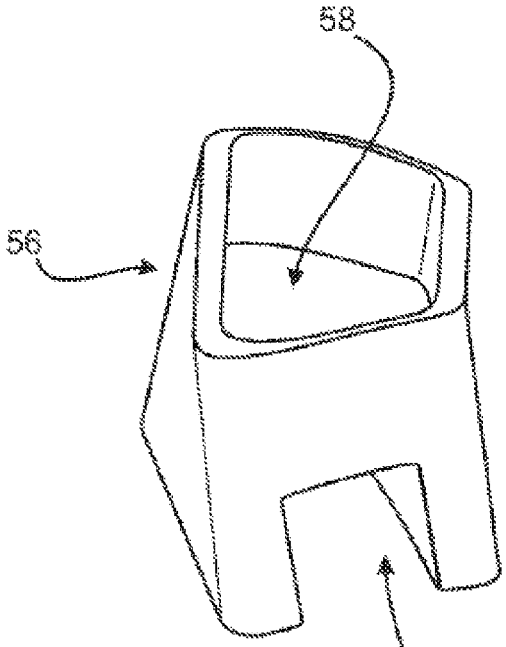
Figure 4C:
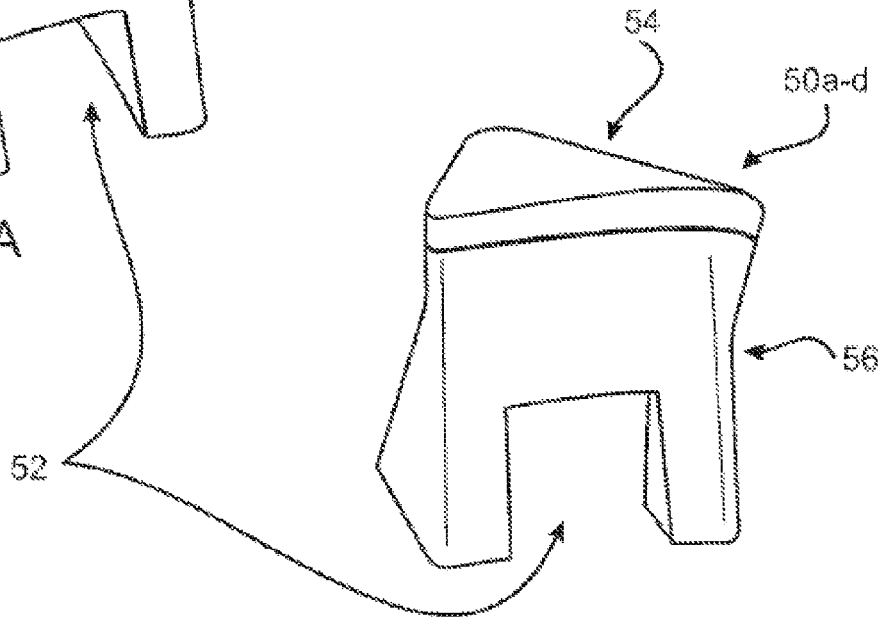

FIGS. 4A-4C depict, in more detail the receptacles 50*a-d* in FIG. 3. Each receptacle 50*a-d* defines a groove 52 that is shaped and sized to be compatible to form a friction fit with the first fixing means in the form of the pair of male members, that define ridges 22*a*, 22*b*. Each receptacle 50*a-d* comprises a removable cap 54 and a body 56 such that when the removable cap is removed a performance monitor component, such as a detectable dye, can be inserted into the cavity 58 in the body 56 of the receptacle.

The removable cap 54 is formed from a material that is less wear resistant than the wear member and is adapted to form a friction fit with the body 56 of the receptacle via a ribbed portion 60 of cap 54.

What is claimed is:

1. A sucker rod guide for use in a well production tubing, the sucker rod guide comprising:

(a) a sleeve member, including a first material having a first wear characteristic and including:

(i) a passage therethrough for a sucker rod; and ii) an outer surface; and (b) a wear member overlaying the sleeve member and including a second material having a second wear characteristic, the wear member being fixed in position relative to the sleeve member by a first fixing means, the sleeve member including:

(i) an inner surface; and (ii) an outer surface defining a flow path for a fluid, when in use, between the sucker rod guide and the well production tubing; and wherein the sleeve member has a higher stiffness than the wear member.

2. The sucker rod guide according to claim 1, wherein the first fixing means comprises a male member and a female member that are compatible insofar as they are adapted to form a friction fit or to otherwise lock together to prevent the relative movement of the wear member and the sleeve member.

3. The sucker rod guide according to claim 2, wherein the male member projects from the outer surface of the sleeve member and the female member is formed on the inner surface of the wear member.

4. The sucker rod guide according to claim 3, wherein the male member has a first end and a second end and extends lengthwise along the outer surface of the sleeve member between said ends to define a first path.

5. The sucker rod guide according to claim 4, wherein the first path is a spiral or a helix.

6. The sucker rod guide according to claim 1, wherein the first wear characteristic comprises a lower wear resistance than the wear member.

7. The sucker rod guide according to claim 1, wherein the wear member is more wear resistant than the sleeve member.

8. The sucker rod guide according to claim 1, wherein the wear member further comprises a fluid flow enhancer.

9. The sucker rod guide according to claim 1, further comprising a retaining means for a performance monitor component.

10. The sucker rod guide according to claim 1, further comprising a performance monitor component.

11. The sucker rod guide according to claim 10, wherein the performance monitor component comprises a detectable material.

12. A method for manufacturing a sucker rod guide, the method comprising the steps of:

(a) providing a sleeve member, including a first material having a first wear characteristic and including a passage therethrough for a sucker rod and an outer surface; and (b) forming a wear member over the sleeve member such that it is fixed in position relative to the sleeve member;

wherein the wear member comprises a second material having a second wear characteristic and the sleeve member has a higher stiffness than the wear member.

13. The method according to claim 12, wherein the step of forming a wear member over the sleeve member comprises moulding.

14. A method for manufacturing a sucker rod guide, the method comprising the steps of:

(a) providing a sucker rod;

(b) fixing a sleeve member to the sucker rod wherein the sleeve member includes a first material having a first wear characteristic, a passage therethrough for the sucker rod and an outer surface; and (c) forming a wear member over the sleeve member such that it is fixed in position relative to the sleeve member, wherein the wear member comprises a second material having a second wear characteristic, the sleeve member having a higher stiffness than the wear member, and wherein the sleeve member and the wear member together form a sucker rod guide.

15. The method according to claim 14, wherein the step of fixing a sleeve member to the sucker rod comprises moulding.

16. The method according to claim 14, further comprising the step of locating a retaining means for a performance monitor component on the sleeve member prior to the step of forming a wear member.

17. The sucker rod guide according to claim 11, wherein the performance monitor component is configured to release the detectable material when wear of the sucker rod guide breaches a part of said retaining means and the detectable material is released therefrom or is otherwise detectable.

18. The sucker rod guide according to claim 11, wherein the detectable material is selected from a group consisting of: a coloured material, a fluorescent material, a radioactive material, fluorescein, 1,3,6,8 pyrenetetrasulfonic acid, sodium salt, rhodamine, alexa, and eFlour.

19. The sucker rod guide according to claim 1, wherein the sleeve member comprises a stiffness of at least 9-20, 10-15, 10, 11, 12, 13, 14, 15, 16, 17, 18, 19 or 20 GPa.

20. A sucker rod comprising the sucker rod guide according to claim 1.

* * * * *